US011763976B2

(12) United States Patent
Dai et al.

(10) Patent No.: US 11,763,976 B2
(45) Date of Patent: Sep. 19, 2023

(54) INTEGRATED MAGNETIC ASSEMBLIES AND METHODS OF ASSEMBLING SAME

(71) Applicant: ABB Power Electronics Inc., Plano, TX (US)

(72) Inventors: Ke Dai, Shanghai (CN); Lanlan Yin, Shanghai (CN); Tom Sun, Shanghai (CN)

(73) Assignee: ABB Power Electronics Inc., Plano, TX (US)

( * ) Notice: Subject to any disclaimer, the term of this patent is extended or adjusted under 35 U.S.C. 154(b) by 1137 days.

(21) Appl. No.: 16/000,492

(22) Filed: Jun. 5, 2018

(65) Prior Publication Data

US 2019/0043653 A1 Feb. 7, 2019

(30) Foreign Application Priority Data

Aug. 2, 2017 (CN) ..... 201710651662.9

(51) Int. Cl.

| | |
|---|---|
| ***H01F 17/04*** | (2006.01) |
| ***H01F 27/245*** | (2006.01) |
| ***H01F 27/26*** | (2006.01) |
| ***H01F 27/30*** | (2006.01) |
| ***H01F 27/38*** | (2006.01) |
| ***H01F 3/14*** | (2006.01) |
| ***H01F 27/28*** | (2006.01) |
| ***H01F 27/29*** | (2006.01) |
| ***H01F 41/02*** | (2006.01) |
| ***H01F 41/04*** | (2006.01) |

(52) U.S. Cl.

CPC ..... *H01F 27/245* (2013.01); *H01F 3/14* (2013.01); *H01F 27/263* (2013.01); *H01F 27/2804* (2013.01); *H01F 27/29* (2013.01); *H01F 27/306* (2013.01); *H01F 27/38* (2013.01); *H01F 41/0233* (2013.01); *H01F 41/041* (2013.01); *H01F 2027/2819* (2013.01)

(58) Field of Classification Search

CPC ..... H01F 27/346
USPC ..... 336/200, 221
See application file for complete search history.

(56) References Cited

U.S. PATENT DOCUMENTS

| | | | |
|---|---|---|---|
| 6,185,114 | B1 | 2/2001 | Matsumoto et al. |
| 6,930,893 | B2 | 8/2005 | Vinciarelli |
| 6,970,367 | B2 | 11/2005 | Takeshima et al. |
| 7,362,594 | B2 | 4/2008 | Tsui et al. |
| 7,613,021 | B2 | 11/2009 | Lanni |

(Continued)

FOREIGN PATENT DOCUMENTS

| | | | |
|---|---|---|---|
| CN | 201773663 | U | 3/2011 |
| CN | 105518810 | A | 4/2016 |

(Continued)

OTHER PUBLICATIONS

Chinese Office Action issued in related Chinese application No. 201710651662.9, dated Mar. 10, 2023, 8 pages.

*Primary Examiner* — Ronald Hinson
(74) *Attorney, Agent, or Firm* — Armstrong Teasdale LLP

(57) ABSTRACT

An integrated magnetic core is provided. The integrated magnetic core includes a first plate and a second plate. The first plate includes a plurality of legs extending outwardly from a first surface of the first plate. The plurality of legs includes first and second oppositely disposed legs and third and fourth oppositely disposed legs. The second plate is coupled to at least the third and fourth legs of the first plate.

17 Claims, 6 Drawing Sheets

(56) References Cited

U.S. PATENT DOCUMENTS

| | | | | |
|---|---|---|---|---|
| 8,344,842 | B1 | 1/2013 | Luzanov | |
| 8,610,528 | B1 | 12/2013 | Luzanov | |
| 9,190,206 | B1 | 11/2015 | Luzanov | |
| 9,697,947 | B1 | 7/2017 | Luzanov | |
| 2010/0232181 | A1* | 9/2010 | Nakahori | H01F 27/2804 363/17 |
| 2014/0340188 | A1* | 11/2014 | Barthold | H01F 27/24 336/214 |
| 2016/0307695 | A1* | 10/2016 | Jitaru | H01F 27/2804 |

FOREIGN PATENT DOCUMENTS

| | | | |
|---|---|---|---|
| JP | S5796512 | A | 6/1982 |
| JP | 2001230120 | A | 8/2001 |
| JP | 2012231069 | A | 11/2012 |
| JP | 2014063856 | A | 4/2014 |

* cited by examiner

INTEGRATED MAGNETIC ASSEMBLIES AND METHODS OF ASSEMBLING SAME

BACKGROUND

The field of the invention relates generally to power electronics, and more particularly, to integrated magnetic assemblies for use in power electronics.

High density power electronic circuits often require the use of multiple magnetic electrical components for a variety of purposes, including energy storage, signal isolation, signal filtering, energy transfer, and power splitting. As the demand for higher power density electrical components increases, it becomes more desirable to integrate two or more magnetic electrical components, such as power transformers and driver transformers, into the same core or structure.

However, known power electronic circuits utilizing an isolated driver transformer design have difficulty in obtaining a symmetrical layout of signal traces from the driver transformer to respective switching devices due to positioning of the main transformer. In high-frequency applications (i.e. above 800 KHZ), the asymmetrical layout may bring serious problems in circuit. As switch frequencies constantly get higher, the impact of an asymmetrical layout is magnified.

BRIEF DESCRIPTION

In one aspect, an integrated magnetic core is provided. The integrated magnetic core includes a first plate and a second plate. The first plate includes a plurality of legs extending outwardly from a first surface of the first plate. The plurality of legs includes first and second oppositely disposed legs and third and fourth oppositely disposed legs. The second plate is coupled to at least the third and fourth legs of the first plate.

In another aspect, a method of assembling an integrated magnetic assembly is provided. The method includes providing a first plate in an integrated magnetic core. The first plate includes a plurality of legs extending outwardly from a first surface of the first plate. The plurality of legs includes first and second oppositely disposed legs and third and fourth oppositely disposed legs, wherein the first and second legs extend a first length from the first surface and the third and fourth legs extend a second length from the first surface that is greater than the first length. The method also includes providing a second plate in the integrated magnetic core, and coupling the second plate to at least the third and fourth legs of the first plate.

Although specific features of various embodiments may be shown in some drawings and not in others, this is for convenience only. Any feature of any drawing may be referenced and/or claimed in combination with any feature of any other drawing.

DETAILED DESCRIPTION

Figure 1:
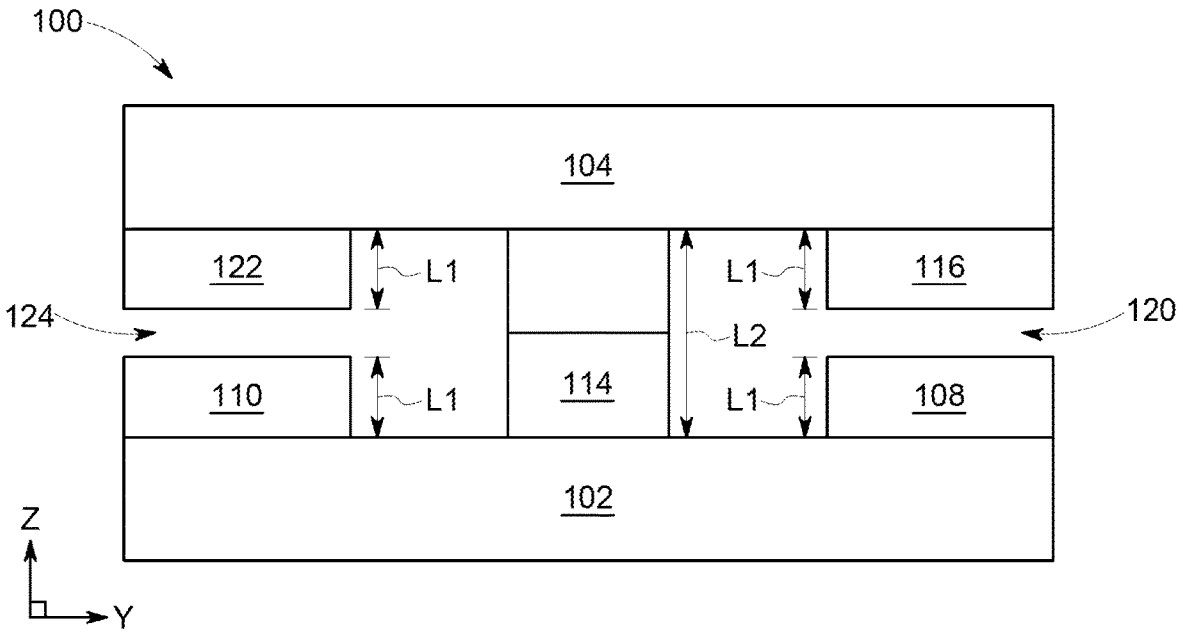
FIG. 1 is a side view of an exemplary integrated magnetic assembly.
Figure 2:
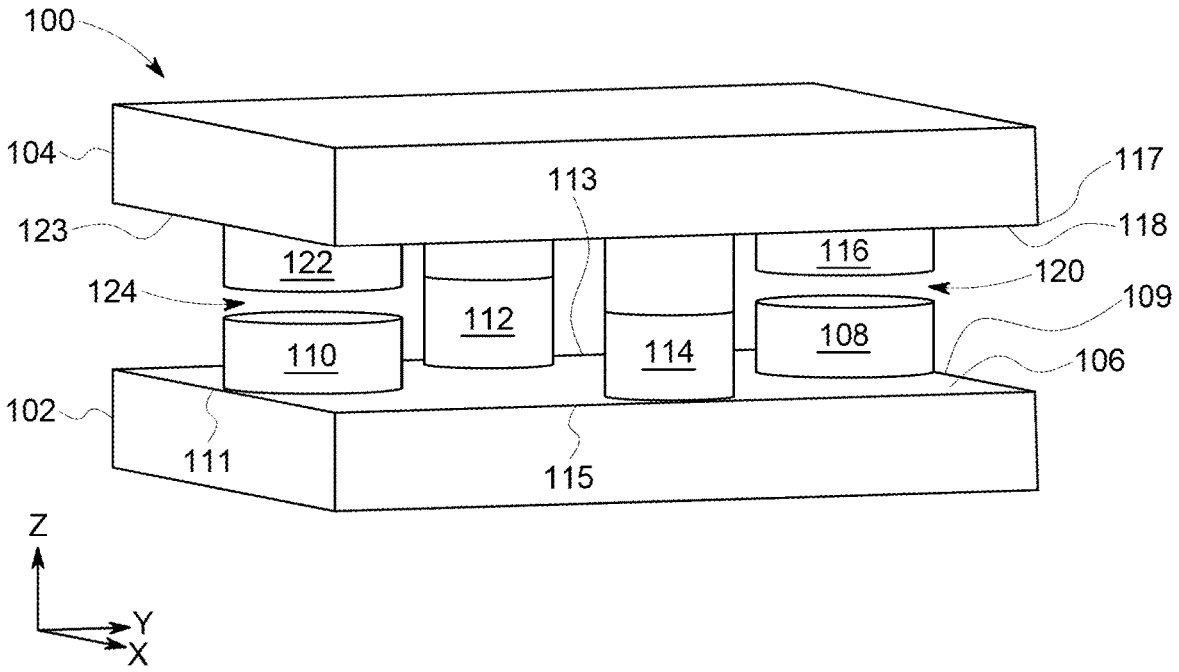
FIG. 2 is a perspective view of the integrated magnetic assembly shown in FIG. 1.

FIG. 1 is a side view of an exemplary integrated magnetic assembly 100. FIG. 2 is a perspective view of integrated magnetic assembly 100 (shown in FIG. 1). Integrated magnetic assembly 100 includes a first plate 102 and a second plate 104. In the exemplary embodiment, first plate 102 and second plate 104 each have a generally square or rectangular shape. However, in other suitable embodiments, first and second plates 102 and 104 may have any shape that enables integrated magnetic assembly 100 to function as described herein. First and second plates 102 and 104 are fabricated using a magnetic material, such as ferrite.

Integrated magnetic assembly 100 also includes a plurality of legs extending outwardly from a first surface 106 of first plate 102. As used herein, the term "leg" is defined as a vertical magnetic structure that forms a portion of an integrated magnetic structure. First surface 106 is a top surface of first plate 102 and faces second plate 104. The plurality of legs include a first leg 108, a second leg 110 oppositely disposed from first leg 108, a third leg 112, and a fourth leg 114 oppositely disposed from third leg 112. More specifically, first leg 108 is positioned adjacent a first edge 109 of first surface 106 of first plate 102, second leg 110 is positioned adjacent a second edge 111, third leg 112 is positioned adjacent a third edge 113, and fourth leg 114 is positioned adjacent a fourth edge 115. First edge 109 and second edge 111 are opposite from one another in the square or rectangular-shaped first plate 102 such that they extend substantially parallel relative to one another along an x-axis of an x-y-z coordinate frame. Third edge 113 and fourth edge 115 are opposite from one another such that they extend substantially parallel relative to one another along a y-axis. Accordingly, second leg 110 being oppositely disposed from first leg 108 and fourth leg 114 being oppositely disposed from third leg 112 means that they are positioned adjacent edges of first plate 102 that oppose one another.

In the exemplary embodiment, legs 108, 110, 112, and 114 extend from first surface 106 of first plate 102 along a z-axis, or in a substantially perpendicular direction relative to first surface 106. When viewed along the z-axis, legs 108, 110, 112, and 114 have a circular-shaped cross-section. However, it is to be understood that in other suitable embodiments, the cross-section of legs 108, 110, 112, and 114 may be any shape that enables legs 108, 110, 112, and 114 to function as described herein, including, but not limited to, a square, a rectangle, a triangle, an oval, etc. Legs 108, 110, 112, and 114 are fabricated using any suitable magnetic material, for example, ferrite. In the exemplary embodiment, first plate 102 and first, second, third and fourth legs 108, 110, 112, and 114 are machined from a single piece of magnetic material (e.g., ferrite). Alternatively, first plate 102 and first, second, third and fourth legs 108, 110, 112, and 114 may be joined together from multiple pieces that are fabricated separately.

First and second legs 108 and 110 extend a first length L1 from first surface 106, and third and fourth legs 112 and 114 extend a second length L2 from first surface 106. In an exemplary embodiment, second length L2 is greater than first length L1.

Second plate 104 is disposed opposite first plate 102, and is coupled to third and fourth legs 112 and 114. Accordingly, the distance between first and second plates 102 and 104 is equal to second length L2.

Second plate 104 includes a fifth leg 116 and a sixth leg 122 extending outwardly from a first surface 118 of second plate 104. First surface 118 is a bottom surface of second plate 104 and faces first plate 102 along the z-axis. Sixth leg 122 is oppositely disposed from fifth leg 116. Fifth leg 116 is positioned adjacent a first edge 117 of first surface 118 of second plate 104, and sixth leg 122 is positioned adjacent a second edge 123 of first surface 118 of second plate 104. First edge 117 and second edge 123 are opposite from one another in the square or rectangular-shaped second plate 104 such that they extend substantially parallel relative to one another along the x-axis. Accordingly, fifth leg 116 being oppositely disposed from sixth leg 122 means that they are positioned adjacent edges of second plate 104 that oppose one another.

Fifth leg 116 and sixth leg 122 each extend substantially perpendicular, or vertically, from second plate 104 along the z-axis in an opposite direction from legs 108, 110, 112, and 114. Fifth leg 116 is axially aligned with first leg 108 along the z-axis such that first and fifth legs 108 and 116 cooperatively define a first gap 120 therebetween. Sixth leg 122 is axially aligned with second leg 110 along the z-axis such that second and sixth legs 110 and 122 cooperatively define a second gap 124 therebetween. Fifth and sixth legs 116 and 122 extend from second plate 104 the same distance that first and second legs 108 and 110 extend from first plate 102, which is first length L1.

When viewed along the z-axis, fifth and sixth legs 116 and 122 have a circular-shaped cross-section. However, it is to be understood that in other suitable embodiments, the cross-section of fifth and sixth legs 116 and 122 may be any shape that enables fifth and sixth legs 116 and 122 to function as described herein, including, but not limited to, a square, a rectangle, a triangle, an oval, etc. Fifth and sixth legs 116 and 122 are fabricated using any suitable magnetic material, for example, ferrite. In some suitable embodiments, second plate 104 and fifth and sixth legs 116 and 122 are machined from a single piece of magnetic material (e.g., ferrite). Alternatively, second plate 104 and fifth and sixth legs 116 and 122 may be joined together from multiple pieces that are fabricated separately. In some suitable embodiments, third and fourth legs 112 and 114 may be formed as part of second plate 104 rather than first plate 102.

Figure 3:
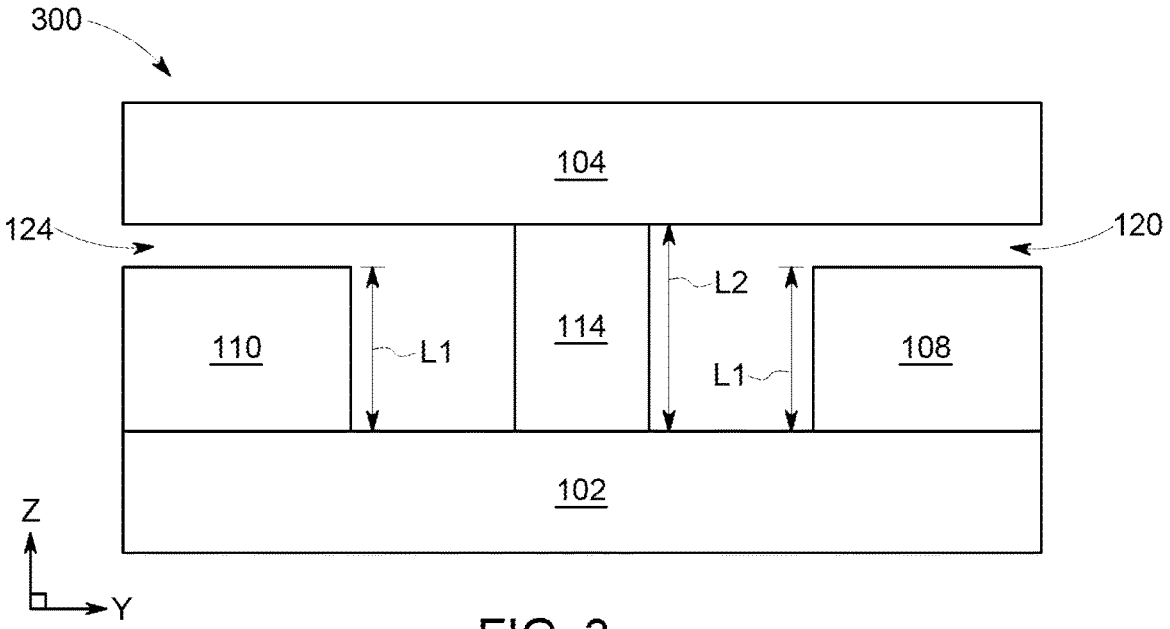
FIG. 3 is a side view of an alternative integrated magnetic assembly.
Figure 4:
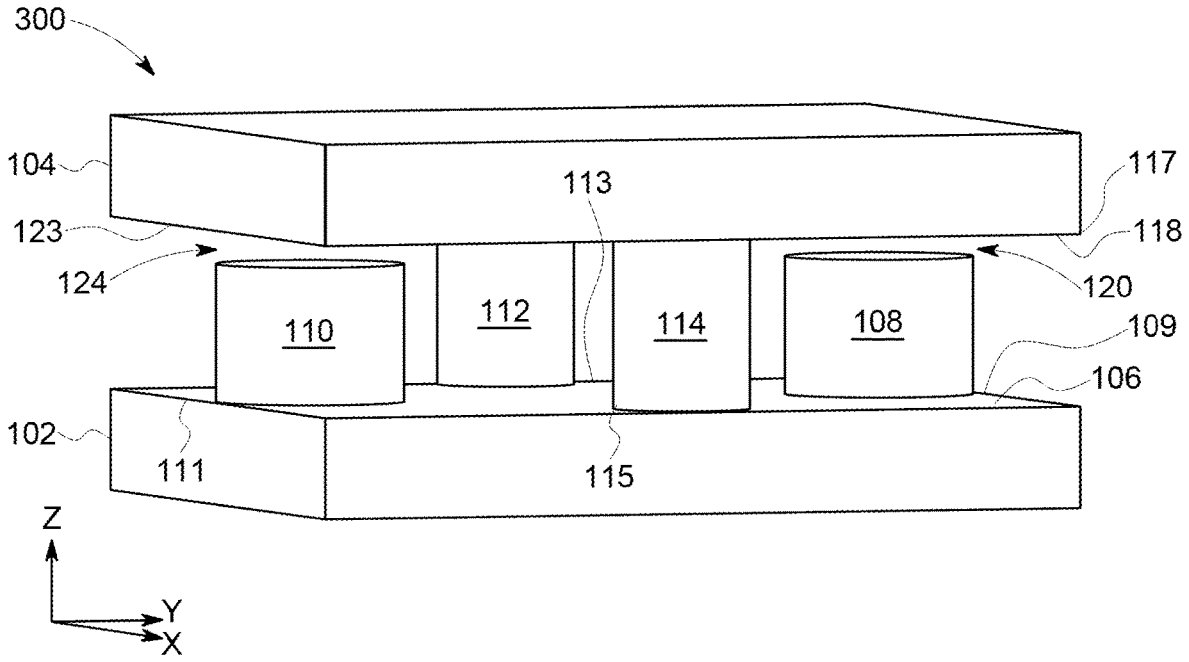
FIG. 4 is a perspective view of the integrated magnetic assembly shown in FIG. 3.

FIG. 3 is a side view of an exemplary integrated magnetic assembly 300. FIG. 4 is a perspective view of integrated magnetic assembly 300 (shown in FIG. 3). In the exemplary embodiment, integrated magnetic assembly 300 is substantially similar to integrated magnetic assembly 100 (shown in FIGS. 1 and 2), except that integrated magnetic assembly 300 excludes fifth and sixth legs 116 and 122, and defines first and second gaps 120 and 124 directly between first and second legs 108 and 110 and second plate 104. Accordingly, components of integrated magnetic assembly 300 that are identical to components of integrated magnetic assembly 100 are identified in FIGS. 3 and 4 with the same reference characters as used in FIGS. 1 and 2.

In the exemplary embodiment, integrated magnetic assembly 300 includes first plate 102, second plate 104, and a plurality of legs extending outwardly from first surface 106 of first plate 102. The plurality of legs include first leg 108, second leg 110 oppositely disposed from first leg 108, third leg 112, and fourth leg 114 oppositely disposed from third leg 112. In the exemplary embodiment, one or more legs 108, 110, 112, and 114 may be offset from edges of first plate 102.

First and second legs 108 and 110 extend a first length L1 from first surface 106, and third and fourth legs 112 and 114 extend a second length L2 from first surface 106. In an exemplary embodiment, second length L2 is greater than first length L1.

Second plate 104 is disposed opposite first plate 102, and is coupled to third and fourth legs 112 and 114. Accordingly, the distance between first and second plates 102 and 104 is equal to second length L2. First length L1 of first and second legs 108 and 110 does not extend all the way to second plate 104. Accordingly, first leg 108 and second plate 104 define a first gap 120, and second leg 110 and second plate 104 define a second gap 124.

Figure 5:
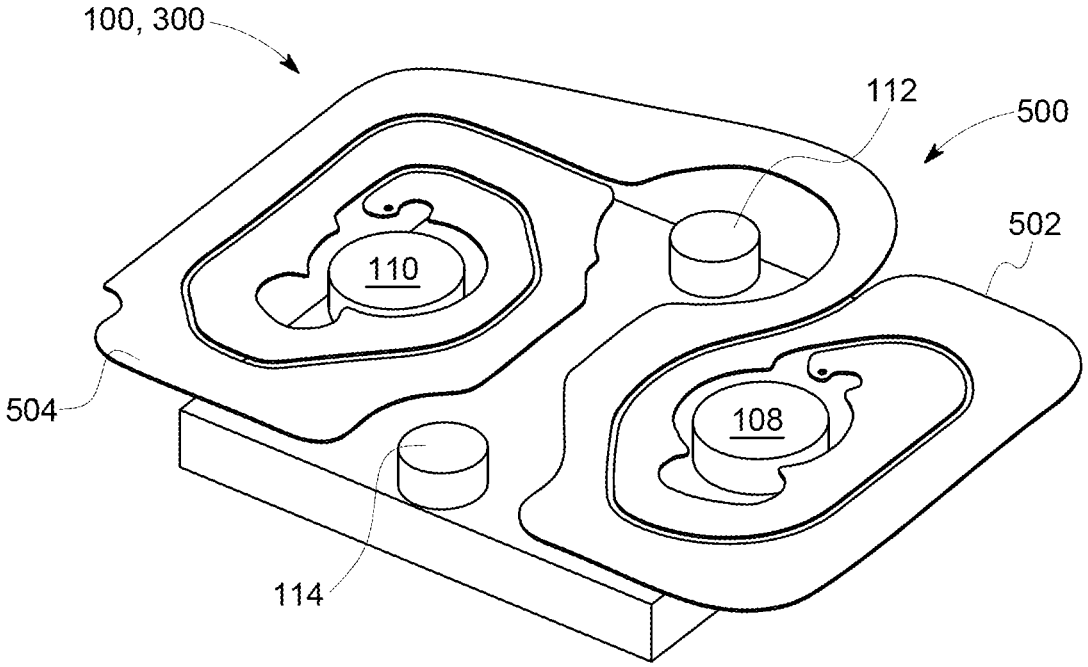
FIG. 5 is a schematic view of an exemplary main transformer including a first main primary winding and a second main primary winding, which may be used with the integrated magnetic assembly shown in FIGS. 1 and 2 or the integrated magnetic assembly shown in FIGS. 3 and 4.

FIG. 5 is a schematic view of an exemplary main transformer 500 including a first main primary winding 502 and a second main primary winding 504, which may be used with integrated magnetic assembly 100 (shown in FIGS. 1 and 2) or integrated magnetic assembly 300 (shown in FIGS. 3 and 4).

Figure 6:
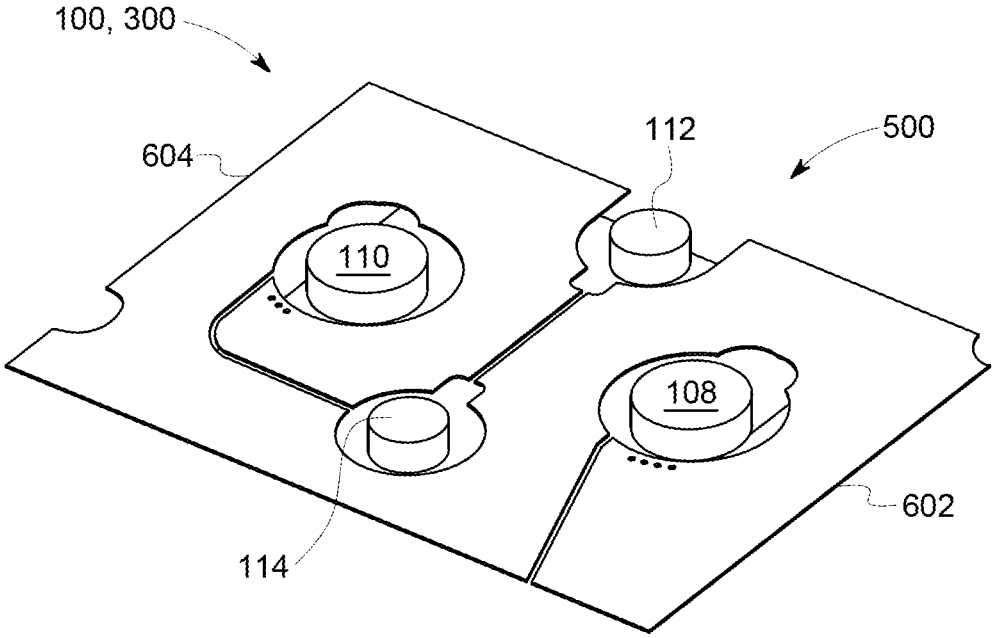
FIG. 6 is a schematic view of the main transformer shown in FIG. 5 including a first main secondary winding and a second main secondary winding, which may be used with the integrated magnetic assembly shown in FIGS. 1 and 2 or the integrated magnetic assembly shown in FIGS. 3 and 4.

FIG. 6 is a schematic view of main transformer 500 including a first main secondary winding 602 and a second main secondary winding 604, which may be used with integrated magnetic assembly 100 (shown in FIGS. 1 and 2) or integrated magnetic assembly 300 (shown in FIGS. 3 and 4).

Figure 7:
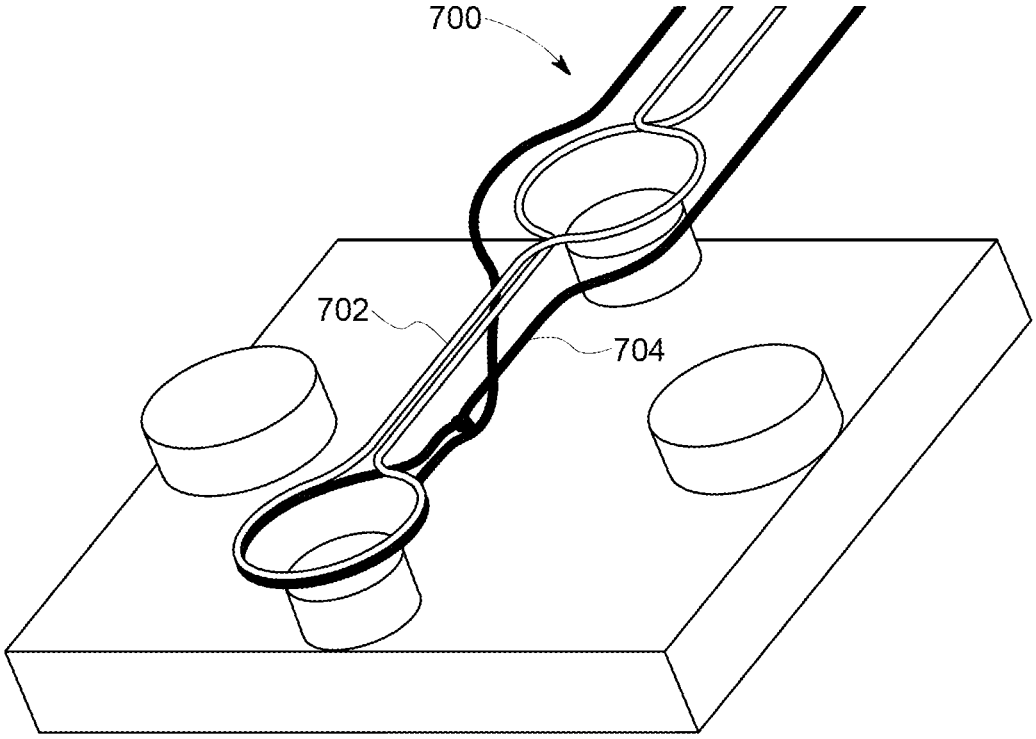
FIG. 7 is a schematic view of a drive transformer including a driver primary winding and a driver secondary winding, which may be used with the integrated magnetic assembly shown in FIGS. 1 and 2 or the integrated magnetic assembly shown in FIGS. 3 and 4.

FIG. 7 is a schematic view of a driver transformer 700 including a driver primary winding 702 and a driver secondary winding 704, which may be used with integrated magnetic assembly 100 (shown in FIGS. 1 and 2) or integrated magnetic assembly 300 (shown in FIGS. 3 and 4).

In the exemplary embodiment, integrated magnetic assembly 100, 300 is implemented in a high density power converter. Alternatively, integrated magnetic assembly 100, 300 may be implemented in a fly back converter, forward converter, push-pull converter, or any other electrical architecture that enables integrated magnetic assembly 100, 300 to function as described herein. Although main transformer 500 is displayed as having printed circuit board-type windings, it is not limited thereto and may use any other type of windings known in the art.

Referring to FIGS. 5-7, in the exemplary embodiment, main transformer 500 is coupled to first and second legs 108 and 110 of integrated magnetic assembly 100, 300. More specifically, main transformer 500 includes first main primary winding 502 (FIG. 5) and first main secondary winding 602 (FIG. 6) coupled to first leg 108, and second main primary winding 504 (FIG. 5) and second main secondary winding 604 (FIG. 5) coupled to second leg 110. In the exemplary embodiment, first main primary winding 502 and first main secondary winding 602 each have a corresponding orientation and the respective orientations have substantially opposite polarity with respect to one another. Further, second main primary winding 504 and second main secondary winding 604 each have a corresponding orientation and the respective orientations have substantially opposite polarity with respect to one another.

A driver transformer 700 is coupled to third and fourth legs 112 and 114. More specifically, driver transformer 700 includes driver primary winding 702 and driver secondary winding 704 coupled to third and fourth legs 112 and 114, respectively. Driver primary winding 702 and driver secondary winding 704 each have a corresponding orientation and the respective orientations have substantially opposite polarity with respect to one another.

Magnetic flux induced in driver transformer 700 by main transformer 500 cancels out. More specifically, magnetic flux induced by main transformer 500 in driver primary winding 702 and driver secondary winding 704 substantially cancels out. That is, magnetic flux induced by main transformer 500 will not affect the operations of driver transformer 700.

If driver primary winding 702 and driver secondary winding 704 are only wound on one leg and the main leg (i.e. from first leg 108 to second leg 110) does not have gaps, then by ignoring the leakage flux in the air, the driver transfer ratio can be treated as:

$$\text{Turn ratio} = N \times \frac{\phi 2}{\phi}$$

$$\frac{\phi 2}{\phi} = \frac{1}{\left(\frac{R2}{R1} + \frac{R2}{R3} + 1\right)}$$

The ϕ is flux generated by driver primary winding 702, ϕ2 is the coupled flux to driver secondary winding 704. R1 is magnetic reluctance of a loop defined from third leg 112 to first leg 108, R2 is magnetic reluctance of a loop defined from third leg 112 to fourth leg 114, and R3 is magnetic reluctance of a loop defined from third leg 112 to second leg 110.

If the main flux leg from first leg 108 to second leg 110 has first and second gaps 120 and 124, R1 and R3 would be much larger than R2 and the turn ratio is very close to N. However, if the main flux leg from first leg 108 to second leg 110 does not include first and second gaps 120 and 124, R1, R3 and R2 are in same order of magnitude and the turn ratio would be reduced.

The turn ratio is very import to driver transformer 700. If the turn ratio is reduced, it may result in insufficient driver voltage. Meanwhile, the fluxes ϕ1 and ϕ3 would affect the flux of main transformer 500, by not only bringing more core loss to the main leg, but also may affect the main transformer function.

Figure 8:
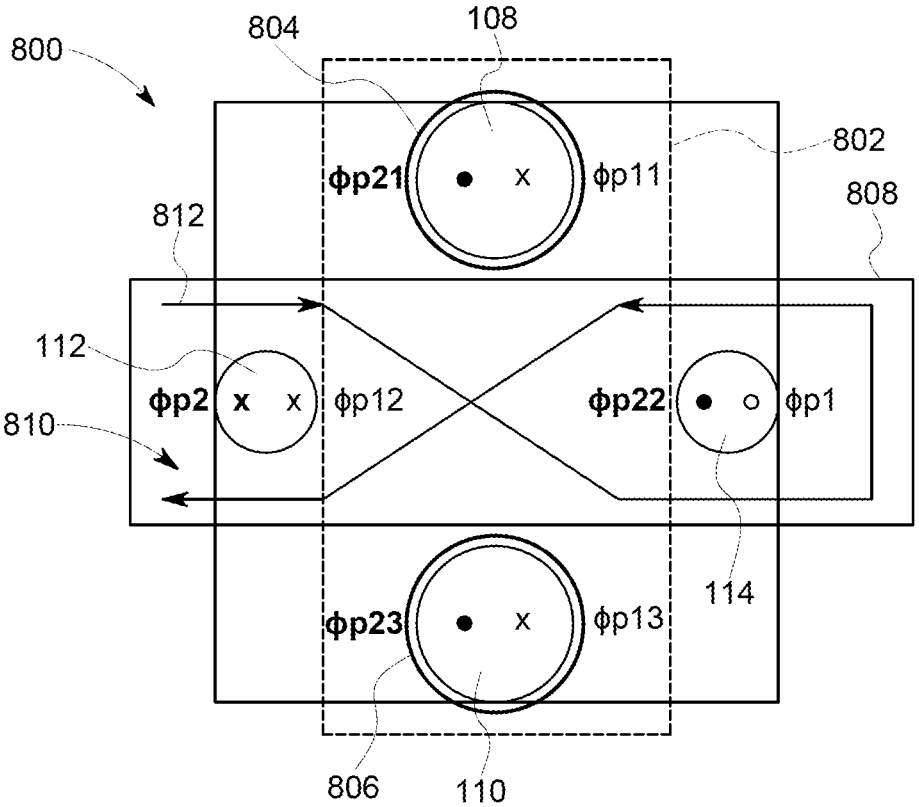
FIG. 8 is a top schematic view of an alternative integrated magnetic assembly illustrating a direction of a driver primary winding.
Figure 9:
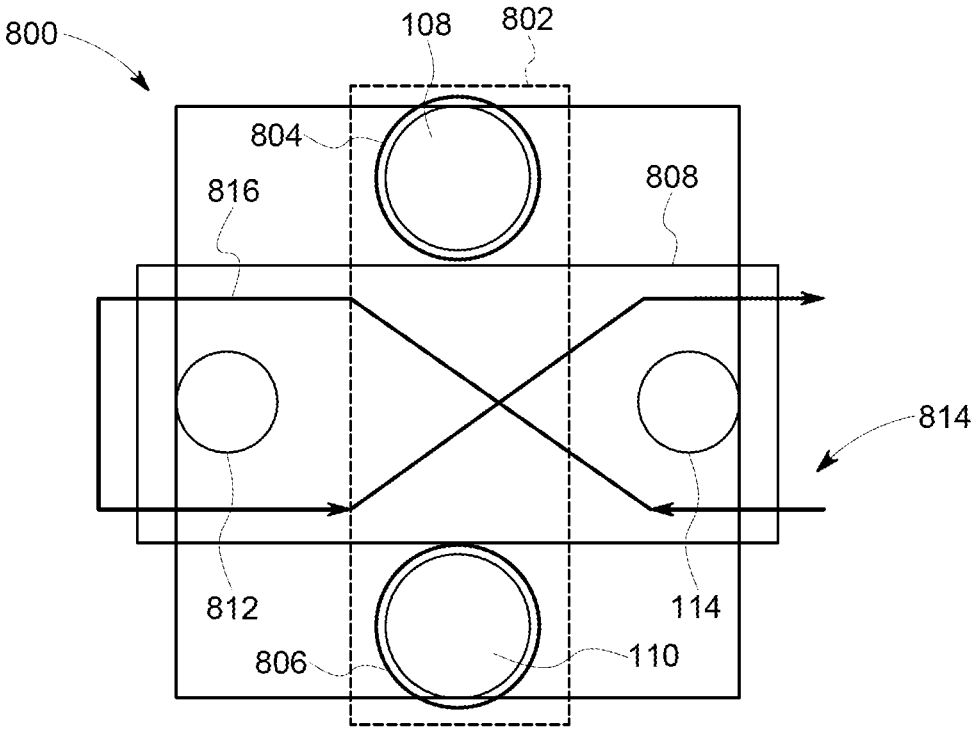
FIG. 9 is a top schematic view of the integrated magnetic assembly shown in FIG. 8 illustrating a direction of a driver secondary winding.

FIG. 8 is a top schematic view of an alternative integrated magnetic assembly 800 illustrating a direction of a driver primary winding. FIG. 9 is a top schematic view of integrated magnetic assembly 800 illustrating a direction of a driver secondary winding. Unless specified, alternative integrated magnetic assembly 800 is substantially similar to integrated magnetic assembly 100 (shown in FIG. 1).

In integrated magnetic assembly 800, main transformer 802 includes main primary winding 804 coupled to first leg 108 and a main secondary winding 806 coupled to second leg 110. No gaps are provided in main transformer 802.

To avoid a transfer ratio reduction in a driver transformer 808 caused by not having gaps, driver transformer 808 includes a driver primary winding 810 coupled to both third leg 112 and fourth leg 114 in a first orientation 812, as shown in FIG. 8. Further, driver transformer 808 includes driver secondary winding 814 coupled to both third leg 112 and fourth leg 114 in a second orientation 816, as shown in FIG. 9. First and second orientations 812 and 816 may be the same or opposite from one another. Magnetic flux generated by driver transformer 808 in main transformer 802 substantially cancels out. More specifically, magnetic flux generated by driver primary and driver secondary windings 810 and 814 in main primary and main secondary windings 804 and 806 substantially cancel out.

For example, for driver primary winding 810 wounded on two legs (e.g., third and fourth legs 112 and 114 as shown in FIG. 8: ϕp1 is the flux generated by driver primary winding 810 wounded on a first core leg (fourth leg 114); ϕp2 is the flux generated by driver primary winding 810 wounded on a second core leg (third leg 112); ϕp11, ϕp12, ϕp13 are the coupled flux of ϕp1 to first, fourth, and second legs 108, 114, and 110. ϕp21, ϕp22, ϕp23 are the coupled flux of ϕp2 to first, fourth, and second legs 108, 114, and 110. A turn number of driver primary winding 810 on the core legs (third and fourth legs 112, 114) are the same. A turn number of driver secondary winding 814 on the core legs are the same.

If fourth leg 114 and third leg 112 have symmetrical positions relative to first and second legs 108 and 110, then K1 (fourth leg 114 to first leg 108), K2 (third leg 112 to first leg 108) are the same, ϕp1=ϕp2, therefore ϕp21=ϕp11

$$K1 = \frac{\phi p11}{\phi p1} \quad K2 = \frac{\phi p21}{\phi p2}$$

The flux cancels in first leg 108 as there is no extra magnetic flux in first leg 108 and second leg 110 generated by driver primary winding 810. Ignoring leakage flux in the air, the flux going through fourth leg 114 generated by driver primary winding 810 would be all directly coupled to driver secondary winding 814 wounded on fourth leg 114. Regarding third leg 112, for all the flux generated by driver primary winding 810 going through driver secondary winding 814, the turn ratio would be maintained without reduction.

Figure 10:
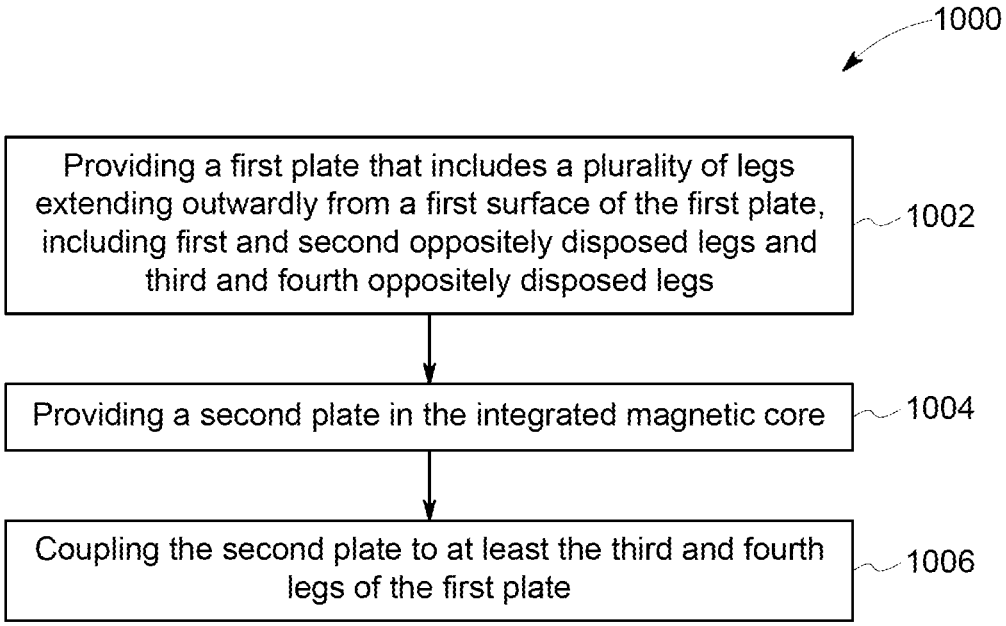
FIG. 10 is a flowchart of an exemplary method of assembling the integrated magnetic assembly shown in FIG. 1 or the integrated magnetic assembly shown in FIG. 3.

FIG. 10 is a flowchart of an exemplary method 1000 of assembling an integrated magnetic assembly, such as the integrated magnetic assembly 100 (shown in FIG. 1) or integrated magnetic assembly 300 (shown in FIG. 3). A first plate, such as first plate 102, is provided 1002. The first plate includes a plurality of legs extending outwardly from a first surface of the first plate, including first and second oppositely disposed legs and third and fourth oppositely disposed legs. The first and second legs extend a first length from the first surface and the third and fourth legs extend a second length from the first surface that is greater than the first length. A second plate, such as second plate 104, is provided 1004. The first plate and the second plate are included in an integrated magnetic core. The second plate is coupled 1006 to at least the third and fourth legs of the first plate.

Exemplary embodiments of integrated magnetic assemblies are described herein. An integrated magnetic core includes a first plate and a second plate. The first plate includes a plurality of legs extending outwardly from a top surface of the first plate. The plurality of legs include first and second oppositely disposed legs and third and fourth oppositely disposed legs. The second plate is coupled to at least the third and fourth legs of the first plate.

As compared to at least some integrated magnetic assemblies, in the systems and methods described herein, an integrated magnetic assembly utilizes split legs for to include both a main transformer and a driver transformer in the same assembly. This enables signal traces from the driver transformer to switches in an isolated driver transformer design to have a symmetrical layout. The integrated magnetic assembly reduces printed circuit board footprint, thereby minimizing power losses and increasing the efficiency of the integrated magnetic assembly.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An integrated magnetic assembly comprising: a first plate comprising a plurality of legs extending outwardly from a first surface of said first plate, the plurality of legs including first and second oppositely disposed legs and third and fourth oppositely disposed legs; a second plate coupled to at least said third and fourth legs of said first plate; and a first transformer coupled to the first and second legs and including a first primary winding and a first secondary winding, wherein the first primary winding is wound around the first leg and the first secondary winding is wound around the first leg; and a second transformer coupled to the third and fourth legs and including a second primary winding and a second secondary winding, wherein the second primary winding is only wound around the third leg and the fourth leg, and the second secondary winding is only wound around the third and the fourth leg.

2. The integrated magnetic assembly according to claim 1, wherein said first and second legs extend a first length from said first surface and said third and fourth legs extend a second length from said first surface that is greater than the first length.

3. The integrated magnetic assembly according to claim 2, wherein said second plate comprises:

a fifth leg extending outwardly from a first surface of said second plate, said fifth leg axially aligned with said first leg such that said first and fifth legs cooperatively define a first gap therebetween; and a sixth leg oppositely disposed from said fifth leg and extending outwardly from the first surface of said second plate, said sixth leg axially aligned with said second leg such that said second and sixth legs cooperatively define a second gap therebetween.

4. The integrated magnetic assembly according to claim 2, wherein: said first leg and said second plate define a first gap therebetween, and said second leg and said second plate define a second gap therebetween.

5. The integrated magnetic assembly according to claim 1, wherein the first transformer is a main transformer; and the second transformer is a driver transformer.

6. The integrated magnetic assembly according to claim 5, wherein magnetic flux induced in said driver transformer by said main transformer cancels out.

7. The integrated magnetic assembly according to claim 1, wherein said first primary winding and said first secondary winding each have a corresponding orientation and the respective orientations have substantially opposite polarity with respect to one another.

8. The integrated magnetic assembly according to claim 1, wherein said first transformer further comprises:

a third primary winding wound around said second leg; and a third secondary winding wound around said second leg.

9. The integrated magnetic assembly according to claim 8, wherein said third primary winding and said third secondary winding each have a corresponding orientation and the respective orientations have substantially opposite polarity with respect to one another.

10. The integrated magnetic assembly according to claim 1, wherein said second primary winding and said second secondary winding each have a corresponding orientation and the respective orientations have substantially opposite polarity with respect to one another.

11. The integrated magnetic assembly according to claim 1, wherein magnetic flux induced by said first transformer in said second primary winding and said second secondary winding substantially cancels out.

12. The integrated magnetic assembly according to claim 1, wherein magnetic flux generated by said second transformer in said first transformer substantially cancels out.

13. The integrated magnetic assembly according to claim 12, wherein magnetic flux generated by said second primary and second secondary windings in said first and third primary and first and third secondary windings substantially cancel out.

14. A method of assembling an integrated magnetic assembly, said method comprising: providing a first plate in an integrated magnetic core, the first plate including a plurality of legs extending outwardly from a first surface of the first plate, the plurality of legs including first and second oppositely disposed legs and third and fourth oppositely disposed legs, wherein the first and second legs extend a first length from the first surface and the third and fourth legs extend a second length from the first surface that is greater than the first length; providing a second plate in the integrated magnetic core; coupling the second plate to at least the third and fourth legs of the first plate; coupling a first transformer to first and second legs, wherein the first transformer includes a first primary winding and a secondary winding, wherein the first primary winding is wound around the first leg and the first secondary winding is wound around the first leg; and coupling a second transformer to third and fourth legs, wherein the second transformer includes a second primary winding and a second secondary winding, wherein the second primary winding is only wound around the third leg and the fourth leg and the second secondary winding is only wound around the third leg and the fourth leg.

15. The method in accordance with claim 14, wherein the second plate includes a plurality of legs, including fifth and sixth legs, and coupling the second plate to at least the third and fourth legs comprises:

axially aligning the fifth leg to the first leg such that the first and fifth legs cooperatively define a first gap therebetween; and axially aligning the sixth leg to the second leg such that the second and sixth legs cooperatively define a second gap therebetween.

16. The method in accordance with claim 14, wherein coupling the second plate to at least the third and fourth legs comprises:

defining a first gap between the first leg and the second plate; and defining a second gap between the second leg and the second plate.

17. The method in accordance with claim 14, wherein the first transformer is a main transformer; and the second transformer is a driver transformer.

* * * * *